United States Patent [19]

van Hattum et al.

[11] 4,004,177

[45] Jan. 18, 1977

[54] TELEVISION CAMERA TUBE TARGET SUPPORT

[75] Inventors: Jan Otto van Hattum; Willem Antonius Maria Hamersma, both of Eindhoven, Netherlands

[73] Assignee: U.S. Philips Corporation, New York, N.Y.

[22] Filed: June 25, 1975

[21] Appl. No.: 590,316

[30] Foreign Application Priority Data

July 25, 1974 Netherlands ..... 7410035

[52] U.S. Cl. ..... 313/390; 313/383

[51] Int. Cl.[2] ..... H01J 29/02; H01J 31/38

[58] Field of Search ..... 313/383, 390, 417, 451, 313/456, 365

[56] References Cited

UNITED STATES PATENTS 2,452,620 11/1948 Weimer ..... 313/383 X

*Primary Examiner*—Robert Segal

*Attorney, Agent, or Firm*—Frank R. Trifari; George B. Berka

[57] ABSTRACT

A television camera tube in which the electrode which is positioned in front of the photosensitive layer is connected to the envelope by means of lug-shaped springs. To avoid microphonic interferences, the lug-shaped springs engage the wall of the envelope at the area of a bend in the spring so that a lever is formed.

3 Claims, 4 Drawing Figures

Figure 1:
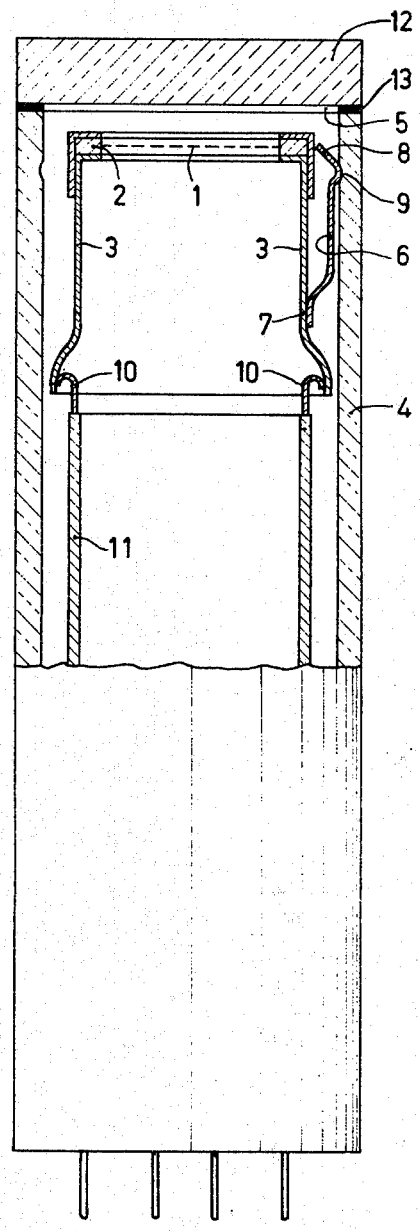

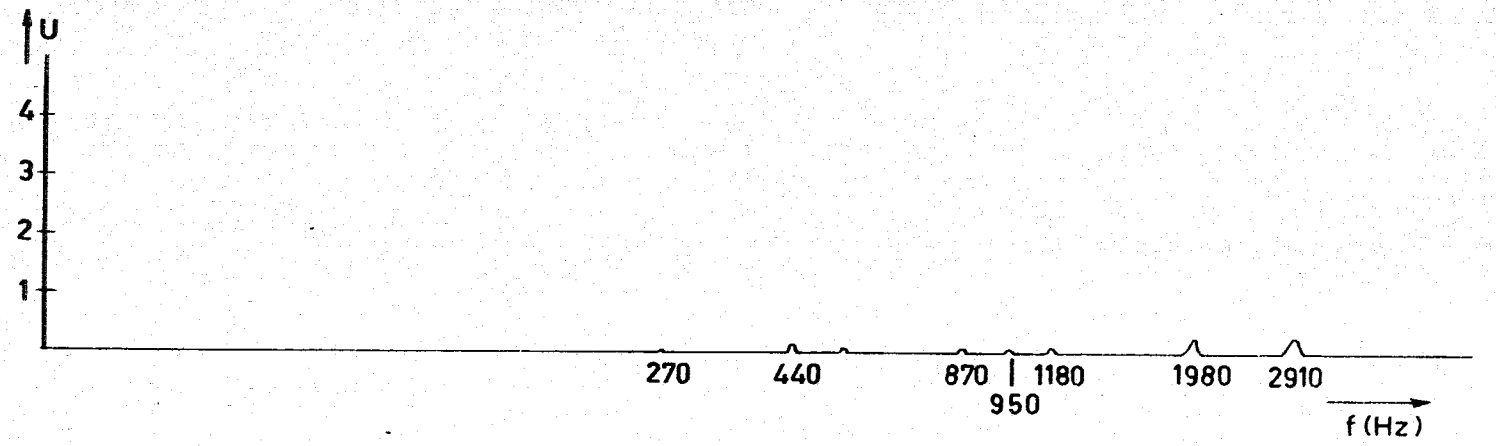
Fig. 3 (1)
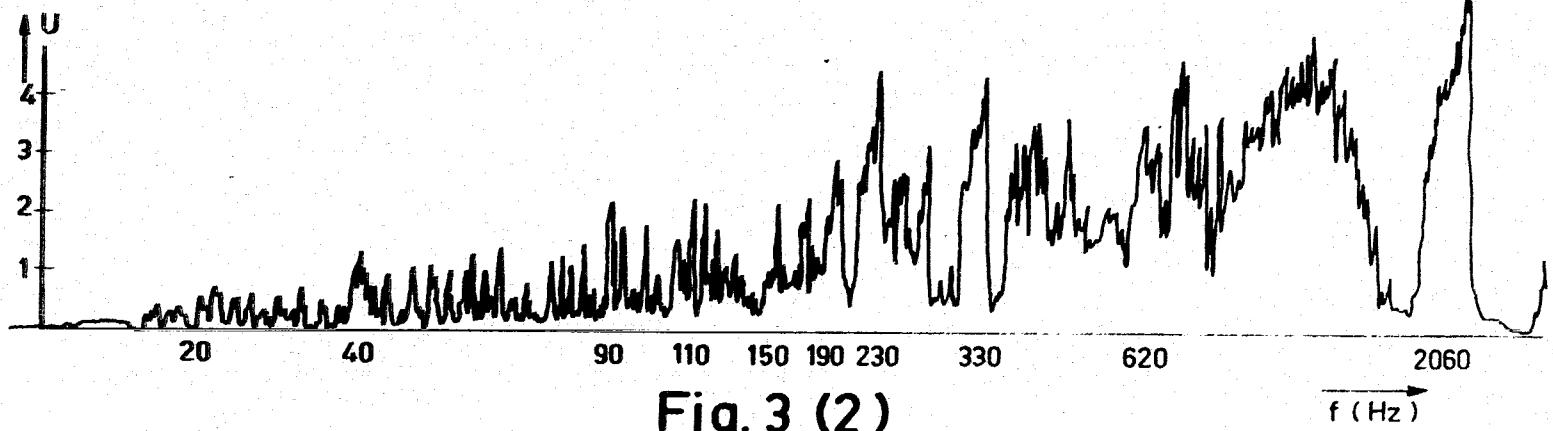
Fig. 3 (2)

TELEVISION CAMERA TUBE TARGET SUPPORT

The invention relates to a television camera tube comprising an evacuated envelope which is mainly cylindrical and has in one end an electron gun and at the other end a face plate with a photosensitive layer, in front of which layer an electrode is provided which is secured to a cylindrical sleeve which is supported in the envelope by means of resilient elements, which resilient elements are secured to the said cylindrical sleeve with one end have such a bent shape that they press against the cylindrical sleeve with their other end, a part of the resilient elements present between the two ends forming a point of contact which presses against the wall of the envelope.

Such a television camera tube is known from the U.S. Pat. No. 3,038,094. In this tube of the "orthicon" type the electron gun produces an electron beam which impinges on the said electrode which is present between the electron gun and a photo-emissive layer and which forms a target which cooperates electrically with the photoemissive layer. the electron beam is focused on the said target and under the influence of deflection means scans the target in which it described a frame of lines.

In another type of television camera tube, the so-called "vidicon", the electron beam scans the photoconductive layer. In that case it is of importance that the said electron beam impinges on the photoconductive layer substantially at right angles. For that purpose the said electrode is gauze-shaped and provided in front of the photoconductive layer. The guaze-shaped electrode has such a lens action on the electron beam that it impinges on the photoconductive layer at right angles.

When such tubes are used in a vibrating or shocking condition (for example in vehicles, machines, space crafts, and the like), the resiliently supported electrode will start vibrating relative to the photosensitive layer and cause so-called "microphonic interferences" which produce a smeared picture.

Springs to obtain a television camera tube having reduced microphony have already been described in the said U.S. patent. Two types of springs are used, namely two having a high spring constant and two having a low spring constant. The fixing in the axial direction takes place by means of a few electrically conductive wires which are passed to the exterior through the glass wall of the envelope. As a result of this the electrode is connected to the envelope in a rather rigid manner. Due to their shape, their location in a plane at right angles to the axis of the tube and the restricted space between the sleeve and the inner wall of the envelope, the springs cannot be sufficiently long and hence become stiff. During assembling the sleeve in the envelope, all the springs must also be depressed simultaneously so as to be able to slide the sleeve into the envelope, which is rather complicated.

It is the object of the invention to provide a television camera tube which has such a construction that both an accurate positioning and fixing and a minimum microphonic interference are obtained. Another object of the invention is to provide a construction which can readily be assembled.

According to the invention, a television camera tube of the kind mentioned in the first paragraph is characterized in that the longitudinal direction of the resilient elements is substantially parallel to the axis of the cylindrical sleeve and the length of the resilient elements is larger than half the length of the cylindrical sleeve.

The invention is based on the recognition of the fact that the said electrode and the cylindrical sleeve to which it is secured must both be fixed readily relative to the photoconductive layer and be capable of springing in a strongly damped manner. This is realized by the said spring construction according to the present invention the great advantage of which is that the springs, due to their assembly in the longitudinal direction, can be given a considerbly longer construction than the springs in the said U.S. patent so that a spring having the desired spring constant can easily be obtained. A simpler and more rapid assembly is also possible, in which the springs engage in recesses of the wall with their point of contact. Each of the resilient elements forms a lever system as a result of which a favourable mutual influencing of the ends of the spring can be established, one end of the spring pressing against the cylindrical sleeve and effecting a damped springing.

A substantially microphony-free tube is obtained if the said points of contact of the springs in a plane at right angles to the axis of the envelope are present substantially through the centre of gravity of the cylindrical sleeve with electrode.

The suppression of microphonic phenomena proves to be maximum if the said point of contact in each resilient element is closer to the end which presses against the sleeve than to the end which is secured to the sleeve, the distance from the point of contact to the end pressing against the sleeve preferably being at most one third of the length of the resilient element.

The said points of contact may also be formed by bends which engage in a recess in the wall of the envelope or the said points of contact may comprise a recess in which a projecting part of the wall engages.

The said recesses and projections may be coaxial grooves and ridges.

The resilient elements may be obtained by incision of the cylindrical sleeve.

Figure 2:
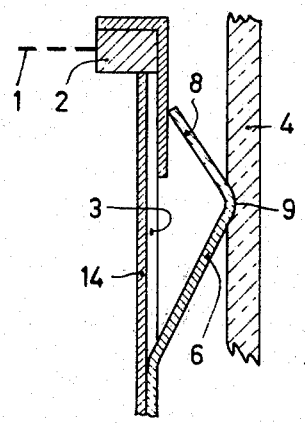

The invention will be described in greater detail with reference to a drawing, in which FIG. 1 is a sectional view of an example of an embodiment according to the invention, FIG. 2 shows another embodiment, FIG. 3 (1) and (2) shows a few measured results, FIG. 1 shows a television camera tube with a gauze-shaped electrode 1 which is assembled in a supporting ring 2 and is clamped in a cylindrical sleeve 3 which consists of two parts and which is positioned coaxially in the envelope 4. The tube furthermore has a photoconductive layer 5 and an electron gun (not shown). The distance from the gauze-shaped electrode 1 to the photoconductive layer 5 is accurately determined and is to remain constant. For that purpose, the cylindrical sleeve 3 is positioned in the envelope 4 by means of a number of springs 6. Said springs 6 are secured to one end 7 of the cylindrical sleeve 3, and press against the other end 8. The spring also presses against the wall of the envelope 4 at the area where its point of contact engages in a recess 9. The cylindrical sleeve 3 is connected electrically to another electrode 11 by means of contact springs 10. Said contact springs should be slack so that they do not transfer vibrations from said electrode 11 to the cylindrical sleeve 3. The cylindrical sleeve 3 may consist of several parts which fit one in the other and/or are secured together. The gauze-shaped electrode 1 is usually mounted in a supporting ring 2 and clamped or welded in the cylindrical sleeve. The window 12 comprising the photoconductive layer 5 is adhered to the envelope or secured to it by means of an indium ring 13. The electron beam generated by the electron gun (not shown) describes a frame of lines over the photoconductive layer 5. Said frame may be parallel lines or concentric circles. The gauze-shaped electrode 1 has a lens effect so that the electron beam impinges upon the photoconductive layer 5 at right angles. The spring 6 may also have a shape different from that shown in the figure without this meaning that the construction falls outside the scope of the claims of the present application. The essential feature, actually, is the double springing effect in which one resilient element is used which partly has a damping springing effect and forms a lever around a point of contact. As shown in FIG. 2, the resilient elements 6 may be cut from the material of the cylindrical sleeve 3, in which case an extra cylindrical sleeve 14 is placed in the sleeve 4 shown in the figure for a good screening.

FIG. 3 (1) shows measured results of an experiment in which a tube of the vidicon type was excited for frequencies between 0 and 3000 Hz with (curve 1) and FIG. 3 (2) without (curve 2) measures according to the invention. In both cases the deflection of the gauze-shaped electrode relative to the photoconductive layer was measured (in arbitrary units) from a capacity variation of the capacitor which is formed by the gauze-shaped electrode and the photosensitive layer. The substantial lacking of microphony (vibrations of the gauze-shaped electrode relative to the photoconductive layer) is clearly demonstrated in the case in which measures according to the invention are taken (curve 1). A remarkable improvement proves to be achieved even above the frequency range shown in FIG. 3.

What is claimed is:

1. A television camera tube comprising an evacuated envelope which is substantially cylindrical and has in one end an electron gun and at the other end a face plate with a photosensitive layer, in front of which layer an electrode is provided which is secured to a cylindrical sleeve which is supported in the envelope by means of resilient elements, which resilient elements are secured to the said cylindrical sleeve with one end and have such a bent shape that they press against the cylindrical sleeve with their other end, a bent part of the resilient elements between the two ends forming a point of contact which presses against the wall of the envelope, and the longitudinal orientation of the resilient elements being substantially parallel to the axis of the cylindrical sleeve and the length of the resilient elements being larger than half the length of the cylindrical sleeve, the said points of contact forming bends which engage in a recess in the wall of the envelope.

2. A television camera tube as claimed in claim 1, wherein the recess in the wall of the envelope is a coaxial groove.

3. A television camera tube as claimed in claim 1, wherein the resilient elements have been obtained by incision of the cylindrical sleeve.

* * * * *